United States Patent [19]

Flum et al.

[11] Patent Number: 4,982,849

[45] Date of Patent: Jan. 8, 1991

[54] ADAPTER MEANS FOR CONVERTING A HORIZONTALLY ARRANGED SHELF MEMBER IN A MODULAR DISPLAY UNIT TO AN ANGULAR ORIENTATION

[75] Inventors: Paul L. Flum, Ladue; Dewalt W. Fowler, Manchester, both of Mo.

[73] Assignee: Paul Flum Ideas, Inc., St. Louis, Mo.

[21] Appl. No.: 489,027

[22] Filed: Mar. 5, 1990

[51] Int. Cl.[5] ..... A47B 47/00; A47B 57/04

[52] U.S. Cl. ..... 211/59.2; 211/188

[58] Field of Search ..... 211/186, 188, 59.2, 211/128, 194; 108/91, 111, 107, 144

[56] References Cited

U.S. PATENT DOCUMENTS

| | | | |
|---|---|---|---|
| 2,769,551 | 11/1956 | Just | 211/59.2 |
| 2,895,186 | 7/1959 | Franks | 211/188 X |
| 4,187,786 | 2/1980 | Feig et al. | 211/188 X |
| 4,467,927 | 8/1984 | Nathan | 211/186 X |
| 4,574,709 | 3/1986 | Lackey et al. | 211/186 X |
| 4,763,796 | 8/1988 | Flum | 211/59.2 |
| 4,785,943 | 11/1988 | Deffner et al. | 211/59.2 |
| 4,886,171 | 12/1989 | Spamer | 211/59.2 |
| 4,930,643 | 6/1990 | Flum | 211/188 |
| 4,940,150 | 7/1990 | Spengler | 211/188 |

*Primary Examiner*—Carl D. Friedman
*Assistant Examiner*—Derek J. Berger
*Attorney, Agent, or Firm*—Haverstock, Garrett & Roberts

[57] ABSTRACT

An adapter member for angularly orienting at least one horizontally disposed shelf member in a modular display unit having one or more similar shelf members vertically arranged in spaced apart relationship one above the other and a plurality of support members disposed therebetween, the adapter member having first and second opposed end portions, the first adapter end portion being adapted to cooperatively engage respective upper and lower portions associated with each of the shelf members, the second adapter end portion being adapted to cooperatively engage the opposed end portions of each of the support members, the first and second adapter end portions being angularly related and tranversely offset relative to each other such that when a plurality of adapter members are operatively positioned between and engaged with the respective shelf members and support members forming the modular display unit, the shelf members engaged with the adapter members will be angularly oriented relative to the horizontal and the support members will be in corresponding vertical alignment with each other throughout the unit. The present adapter is constructed so as to be compatible and engageable with the cooperatively engageable components associated with many known modular display units, and conversion is achieved by integrally incorporating a plurality of the present adapter members into such units in a particular combination and orientation with existing components to form the desired configuration.

7 Claims, 3 Drawing Sheets

ADAPTER MEANS FOR CONVERTING A HORIZONTALLY ARRANGED SHELF MEMBER IN A MODULAR DISPLAY UNIT TO AN ANGULAR ORIENTATION

The present invention relates generally to shelf conversion means for use in conjunction with modular display devices which include substantially planar horizontal display areas for storing and merchandising products thereon and, more particularly, to improved adapter means for converting existing non-gravity feed type modular display devices to gravity feed systems wherein any or all of the horizontal shelf members associated therewith may be realigned in angular orientation to the horizontal so as to cause products displayed on such realigned shelves to slide forward in a gravity feed operation. The present adapter means also enables a user to angularly orient otherwise horizontal display areas for a wide variety of other applications or uses apart from a gravity feed type operation. Importantly, the present adapter means are constructed so as to be compatible and engageable with the cooperatively engageable components associated with many known modular units and, therefore, conversion of such units to angularly oriented display areas can be easily and quickly accomplished. The conversion process requires no modification of the existing components associated with known systems and is achieved by merely incorporating the present adapter means into known systems in a particular combination with existing components to form the desired configuration. The present conversion means is adaptable for use with many of the known modular display units for displaying and merchandising a wide variety of goods therefrom and it is likewise equally adaptable for use in numerous industrial, warehousing, home and other applications.

BACKGROUND OF THE INVENTION

In today's mass merchandising market, economical gravity feed type display devices are both in need and in demand. This is true because gravity feed type product merchandising devices promote sales in that they continuously provide shelved products which are readily available and easily accessible to a user or customer at the front portion of the shelf; they enhance removability of products positioned thereon as a user or customer does not have to reach deep into the shelf area to remove products located thereon; they increase product visibility as products positioned on such gravity feed devices will always be located adjacent the front thereof; and they provide a more attractive and organized display. Because many of the modular display units presently in the marketplace typically support the shelf members or display areas associated therewith in a horizontal position only and such non-gravity feed type units have no capability or adaptability for orienting such display areas so as to achieve a gravity feed operation, a need has developed for means to easily, quickly and economically convert such existing horizontally oriented modular devices to gravity feed systems.

The above referenced need has led to the development of a variety of devices for converting existing non-gravity feed type display devices to gravity feed systems. Several of the known existing devices include angular or wedge shaped members, or other support bracket arrangements, which may be positioned on an existing horizontal surface or attached in some fashion to the rear portion of a non-gravity feed type unit in supportive relationship to a substantially flat shelf member causing one end portion of such shelf member to be elevated so as to produce an inclined surface. For example, see U.S. Pat. Nos. 4,763,796 and 4,886,171 which teach several alternative means for converting known non-gravity feed type displays to gravity feed systems. The devices disclosed in U.S. Pat. Nos. 4,763,796 and 4,886,171 are representative of the known gravity feed conversion devices presently available for converting a non-gravity feed type unit into a gravity feed operation.

Although the known devices provide means for converting existing display units having a plurality of substantially flat horizontal display areas associated therewith into gravity feed type systems, all such prior art means still suffer from certain disadvantages and shortcomings. For example, a reduction in usable space between vertically spaced shelf members occurs with conversion devices which retain the original horizontal shelf member and add to such system an overlaying shelf member which is freestanding or supported at one end by a pedestal or other conversion member. These conversion devices also lack stability and strength as they are not structurally integrated or connected to the components of the original display device. Such known conversion devices are also subject to being dislodged or bumped out of position during stocking and/or use and can be easily lost and/or misplaced. In addition, such converted systems are also subject to racking or other movement depending upon the weight and load distribution of the particular products positioned thereon. None of the known prior art conversion devices discloses an efficient, effective and stable means for achieving a gravity feed conversion as is true of the present adapter means and none discloses the use of a single, universal adapter member which, when properly positioned and arranged in association with the shelf members and upright support members of existing modular units, permits a plurality of vertically spaced, horizontally disposed shelf members to be easily and quickly converted to an angular orientation while still maintaining a stable, unitized and vertically aligned system.

SUMMARY OF THE INVENTION

The present invention overcomes many of the shortcomings and limitations associated with the known conversion devices and teaches the construction and operation of an adapter device which greatly facilitates the conversion of conventional flat shelving structures utilized in many known modular display devices into systems wherein the shelf or display areas are angularly oriented for gravity feed operation or other applications. The existing modular display devices with which the present adapter means are contemplated for use generally include a plurality of similar shelf members and a plurality of elongated support members, the elongated support members having opposite end portions cooperatively engageable with means located on both the upper and lower portions of each respective shelf member. Such means on the shelf member for engaging the elongated support members typically include some type of socket means adapted to receive a correspondingly shaped end portion associated with each support member, such cooperative engagement fixedly maintaining the support members in an upright substantially vertical position relative to such shelf members when engaged therewith. Joinder of the support members to such shelf members is usually accomplished by a compression or friction fit between the respective members and, when properly positioned and joined together, any desired number of vertically disposed shelf members may be achieved. Such an arrangement produces a typical display unit having a plurality of vertically spaced, horizontally arranged shelf members.

Angular orientation of such otherwise horizontally flat shelf members is achieved through use of the present adapter means. The present adapter is specifically designed to be structurally integrated into the particular modular display unit to be converted by inserting the same between the individual shelf members and the elongated support members positioned therebetween where such shelf and support members would otherwise be directly engaged. The present adapter member includes first and second opposed end portions having cooperatively engageable means associated respectively therewith compatible with both the shelf and support members of the particular modular display device to which it is attached. The first end portion of the present adapter means includes outwardly extending means which are insertably receivable into and cooperatively engageable with the socket or other means associated with the upper and lower portions of each respective shelf member, whereas the second end portion of the present adapter means includes receiver means which are cooperatively engageable with the respective end portions of each respective support member. More importantly, in order to achieve the desired inclination or angular orientation to which the otherwise horizontal shelf members are being converted or realigned, the present adapter is constructed such that its opposite end portions are angularly related to each other by an amount equal to the angular orientation desired to be imparted to the particular shelf members to be converted. Also, importantly, in order to maintain vertical alignment of both the plurality of vertically spaced shelf members and the upright support members disposed therebetween in a converted system, the cooperatively engageable means associated with each opposite end of the present adapter are likewise offset or shifted such that the longitudinal axes associated respectively therewith will intersect each other at a point spaced or removed from the actual plane of intersection or proximal area between the first and second adapter portions. The actual amount of offset or shift will vary depending on the particular application and the amount of inclination desired, however, the point of intersection of the respective longitudinal axes will always be towards one of the respective end portions.

The novel offset and angular relationship between the respective end portions of the present adapter in combination with the present adapter's compatibility with the cooperatively engageable means associated with existing modular display devices enables the same configuration of adapter to be used with displays to both impart the desired angular orientation to the individual shelf areas and to maintain all components of such systems in stacked vertical alignment. This is accomplished by engaging a plurality of the present adapters with both the upper and lower socket means of a particular shelf member to be converted, the present adapters engaged with the lower shelf socket means being oriented so as to incline such shelf member relative to the horizontal, whereas the present adapters engaged with the upper shelf socket means are oriented differently so as to maintain the support members positioned thereabove in vertical orientation and alignment with the support members located therebelow. This arrangement of the present adapters also ensures that the shelf members will likewise remain in vertical alignment thoughout the display and some shelf members will not extend or protrude substantially farther either forward or rearward as compared to other shelf members in the display regardless of their orientation. The present adapter is specifically constructed so that it can be positioned and engaged with known shelf members in more than one orientation thereby enabling all support members engaged therewith, both above and below the converted shelf members, to remain in vertical, axial alignment with each other. This is important to the structural integrity of any stackable display system.

The present adapter means is also important because it accomplishes conversion without requiring the use of any tools or other mechanical means for effecting the conversion; it does not reduce usable shelf space including the vertical space between shelf members; it provides greater flexibility and versatility to a user in reorienting shelves of a particular unit to meet the user's specific needs and applications depending upon the type of goods or products being displayed therefrom; it provides a user with a greater range of possibilities for utilizing shelf areas associated with known modular displays; and, when a known system is converted, it provides for a stable, structurally integral and unitized system. This one, universal, standardized adapter member, when properly used and arranged in association with the shelf members and support members of many known modular display units, enables the shelf members associated therewith to be easily and quickly rearranged to achieve the angular orientation desired.

It is therefore a principal object of the present invention to provide improved means for converting horizontal display areas associated with known modular-type display units into angularly oriented display areas.

Another object is to provide an efficient and stable means for converting existing modular-type product display units into gravity feed type systems.

Another object is to provide adapter means which not only convert the horizontally oriented shelf members associated with known modular display devices to an inclined, angular orientation, but also, maintain vertical alignment of all upright support members utilized in the display after conversion.

Another object is to provide adapter means which affords a user a plurality of different options when determining how best to configure a display device for a particular application.

Another object is to provide a converted modular-type display unit having angularly oriented shelf members adaptable for gravity feed or other applications, which converted unit is relatively more stable, durable and able to withstand moderate impact without swaying or collapsing.

Another object is to provide gravity feed type shelf conversion means which is structually integrated into the display system to be converted.

These and other objects and advantages of the present invention will become apparent to those skilled in the art after considering the following detailed specification in conjunction with the accompanying drawings wherein:

DETAILED DESCRIPTION OF THE PREFERRED EMBODIMENT

Figure 1:
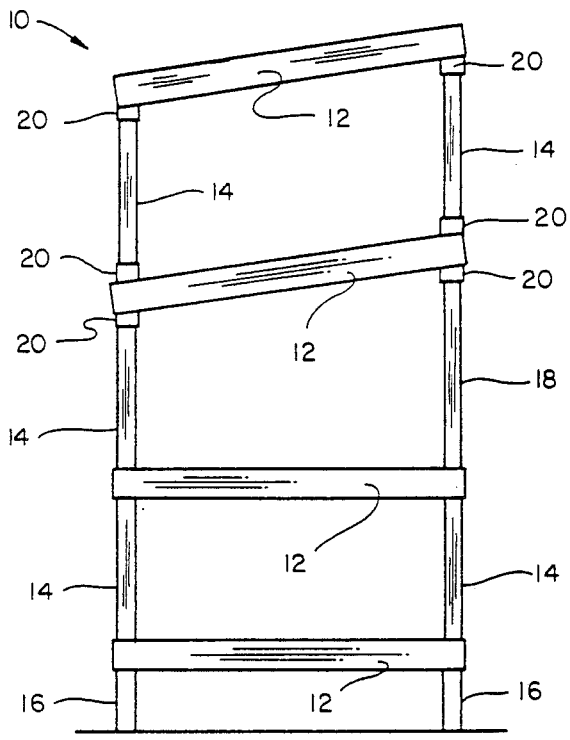
FIG. 1 is a side elevational view of a known modular display unit showing of the present adapter means for reorienting the two uppermost shelf members associated therewith to an inclined, angular orientation.
Figure 2:
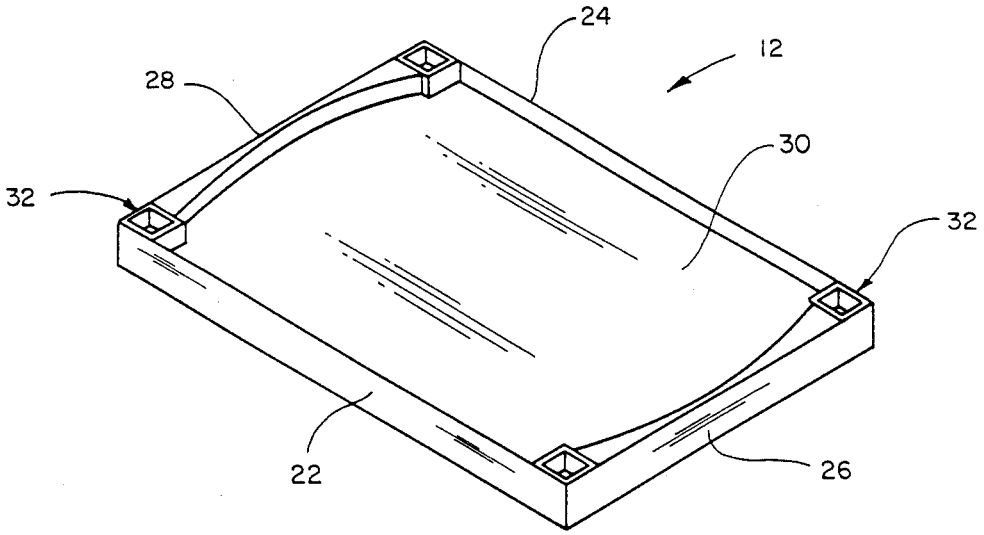
FIG. 2 is a perspective view of a typical shelf member used in known display units such as one of the shelf members shown in FIG. 1.

Referring to the drawings more particularly by reference numbers, wherein like-numerals refer to like-parts, number 10 in FIG. 1 identifies a side elevational view of a conventional modular non-gravity feed type product display device having some of its horizontally arranged shelf members converted to an angular orientation in accordance with the teachings of the present invention. The display device 10 includes a plurality of substantially similar shelf members 12, a plurality of elongated support members 14 positioned in supportive relation between the spaced apart shelves 12 for vertically stacking the same one above the other, and a plurality of gravity feed adapters 20 located between the converted shelf members 12 and the respective support members 14 and 18 associated therewith as shown in FIG. 1. Each shelf member 12 is designed to support and merchandise products positioned thereon and each includes spaced front and rear wall portions 22 and 24, spaced side wall portions 26 and 28, and a generally planar floor portion 30 which extends substantially the full length and width of the member 12 between the respective wall portions as shown in FIG. 2. Although a particularly shaped shelf member 12 is illustrated in FIG. 2, it is recognized that the shelf members 12 may be fashioned into a variety of differences and shapes, for example, square, circular, hexagonal, or some other configuration, without impairing the teachings of the present adapter means so long as such shelf members are capable of being stackably arranged in spaced apart relationship one above the other as will be hereinafter explained.

Figure 3:
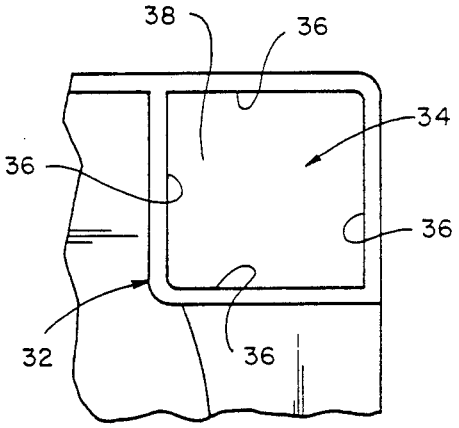
FIG. 3 is an enlarged fragmentary top plan view of a portion of the shelf member of FIG. 2 showing one of the upper socket means associated therewith.

The known shelf members 12 typically include means such as the sockets or receptacles 32 (FIGS. 2 and 3) adapted to cooperatively engage the elongated support members associated with such known modular systems such as the support member 14, 16 and 18. The socket means 32 are each respectively positioned and located adjacent the upper surface of the floor 30 at approximately the respective corners of each shelf member 12 as shown in FIG. 2. Each socket 32 (FIG. 3) includes a cavity or enclosure 34 which is sized and shaped to receive and engage a correspondingly shaped end portion associated with the upright support members 14, 16 and 18. Each enclosure 34 is defined by a plurality of side walls 36 which form locating surfaces for positioning and locating the opposed end portions of the respective support members within each such enclosure. The sockets or receptacles 32 also include a bottom or floor surface 38 which forms a bearing surface for engaging the respective end portions of the support members. The socket floor 38 also helps to fixedly maintain the support members in an upright substantially vertical position relative to the shelf floor 30 when engaged therewith as shown in FIG. 1. Although the socket means 32 are shown as being substantially square in shape (FIG. 3), as with the size and shape of the support members 14, 16 and 18, it is recognized that the cavities 34 may likewise be fashioned in a wide variety of different configurations without impairing the teachings of the present adapter means so long as the cavites 34 are adapted to receive and engage the opposed end portions of the associated support members. Many compatible configurations of upright support members and shelf means engageable therewith are presently being used in known modular systems.

Figure 4:
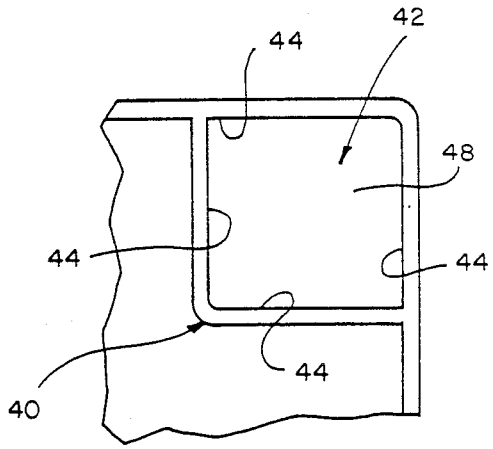
FIG. 4 is an enlarged fragmentary bottom view of a portion of the shelf member of FIG. 2 showing one of the lower socket means associated therewith.
Figure 8:
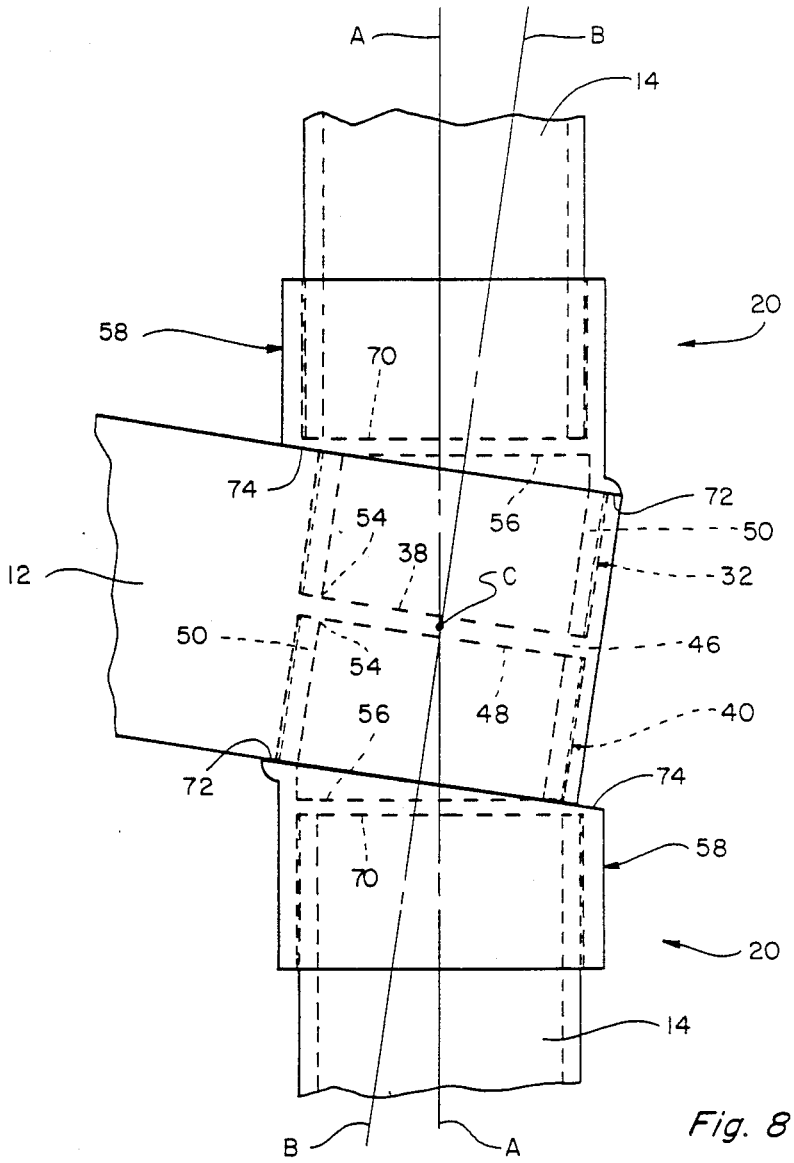
FIG. 8 is a partial side elevational view showing proper positioning and use of the present adapter means for angularly orienting an intermediate shelf member associated with a particular modular display so as to maintain the elongated support members associated therewith, both above and below the particular shelf member, in vertical alignment with each other.

The underside portion of each of the shelf members 12 likewise includes a plurality of socket or receptacle means 40 as best shown in FIG. 4. Like the upper socket means 32, the lower socket means 40 are located at approximately the respective corners of each shelf member 12 and such sockets are generally positioned in axial alignment with the upper socket means 32 as best shown in FIG. 8. Similarly, each socket 40 includes a cavity or enclosure 42 adapted for receiving and engaging a correspondingly shaped end portion associated with the support members 14, 16, and 18, each cavity 42 including side wall portions 44 which form locating surfaces for positioning and locating the opposed end portions of the respective support members within each such cavity. Each socket or receptacle 40 also includes a top surface 48 which likewise forms a bearing surface for engaging the respective end portions of the support members when positioned therewithin. As best shown in FIG. 8, the bottom surface 38 of shelf cavity 34 and the top surface 48 of shelf cavity 42 define the intermediate wall 46, which wall 46 extends between the respective upper and lower cavities 34 and 42 serving as a common bottom/top wall for each such cavity. By interconnecting the support members 14 with the respective shelf socket means 32 and 40, the shelf members 12 may be stackably arranged one above the other to achieve any desired number of vertically disposed, horizontally oriented, shelf members. In this regard, it should be noted that any such modular arrangement of shelf members 12 may include a plurality of leg members 16 engageable with the lower socket means 40 associated with the lowermost shelf member 12 as shown in FIG. 1, the leg members 16 being substantially identical in construction to the support members 14 but differing therefrom in length only for obvious reasons.

Figure 5:
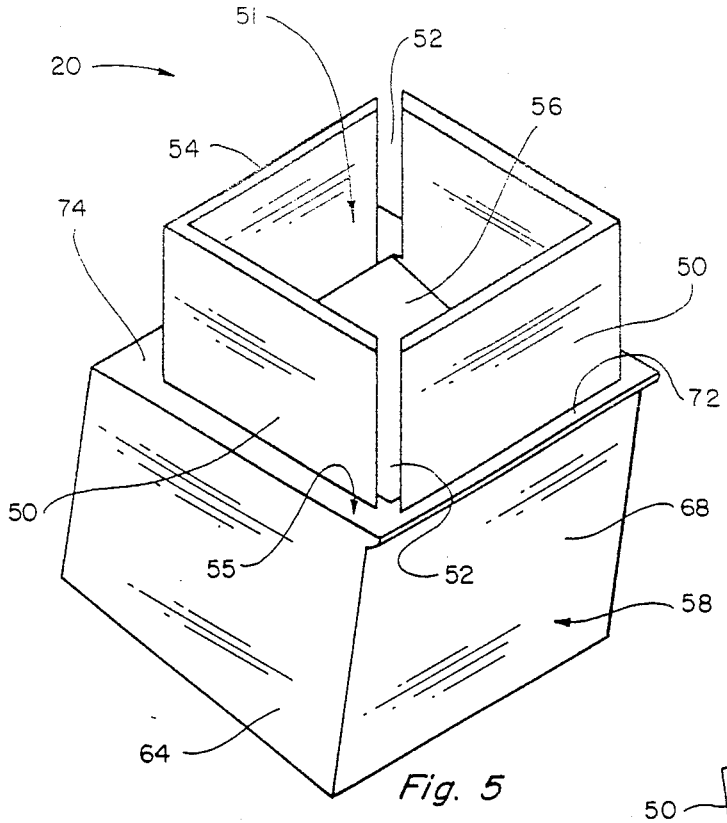
FIG. 5 is a perspective view of the present adapter means constructed according to the teachings of the present invention.
Figure 7:
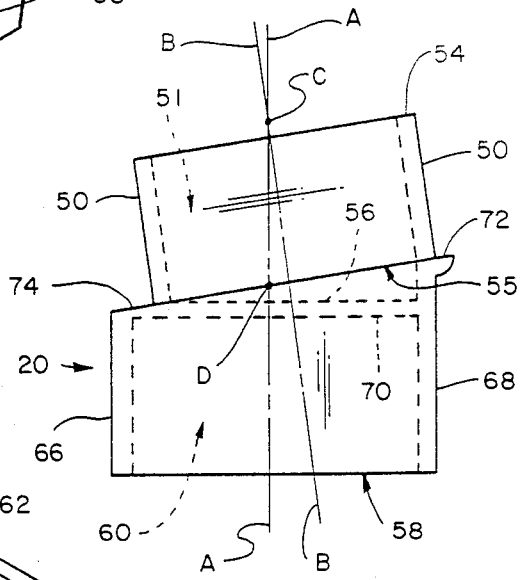
FIG. 7 is a side elevational view of the present adapter means showing the angular relationship between the adapter end portions.
Figure 6:
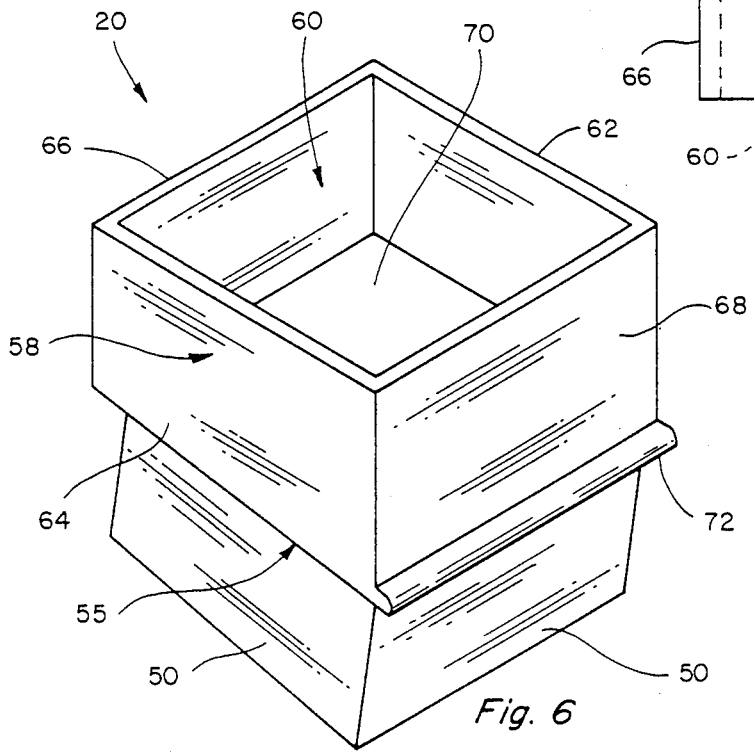
FIG. 6 as a perspective view of the present adapter means of FIG. 5 showing the opposite end portion thereof.

The present adapter member 20 as illustrated in FIG. 5—7 is specifically constructed to be used in conjunction with the shelf members 12 and the support members 14 and 18 so as to angularly orient such otherwise horizontally disposed shelf members as shown in FIG. 1. Each adapter member 20 includes means in the form of locating wall portions 50 associated with one end portion thereof, the wall portions 50 being positioned and arranged adjacent the peripheral wall or shoulder portion 55 so as to cooperatively engage the respective upper and lower socket means 32 and 40 associated with each shelf member 12. In the embodiment illustrated in FIGS. 5—7, the wall portions 50 define a substantially square enclosure 51 sized so as to correspond to the size and shape of the respective socket means 32 and 40, the wall portions 50 being frictionally engageable with either of the socket means 32 and 40. In this regard, since the wall portions 50 are preferably wedged into the sockets 32 and 40, the members 50 are preferably separated by a narrow slot or space 52 as shown in FIG. 5 so as to enhance the resiliency or inward movement of such members to ensure an extremely tight compression fit between the members 50 and the sockets 32 and 40. Since the present adapter members 20 are preferably made of a plastic type material as will be hereinafter discussed, the locating wall portions 50 will inherit the resulting spring tension or elasticity associated with the particular plastic material utilized to achieve the necessary rigid connection between this portion of the adapter member 20 and the respective sockets 32 and 40. It is also important to recognize that the locating wall portions 50 may likewise be fashioned and configured into a variety of different sizes and shapes, for example, circular, triangular, hexagonal, or some other configuration, so long as such cooperatively engageable means are compatible with the particular size and shape of the socket means 32 and 40 associated with the shelf members 12.

The enclosure 51 formed by the wall portions 50 is closed at one end portion thereof by the floor surface 56 which serves to separate such enclosure from the adapter socket cavity 60 located at the opposite end of the adapter 20 as best shown in FIG. 7. The floor surface 56 is substantially horizontal in orientation and extends below and is angularly related to the peripheral wall portion 55 as shown in FIG. 7. Although it is recognized that the floor of the enclosure 51 could be formed by extending inclined wall portion 55 completely across the enclosure 51 formed by and between the respective wall portions 50, and such an arrangement would work equally as well, the location and positioning of floor surface 56 as shown in FIG. 7 is particularly advantageous when viewed in terms of manufacturing and cost effectiveness. Other floor arrangements are likewise anticipated and contemplated.

As best shown in FIG. 8, it is important that the peripheral or circumferential wall portion 55 abut the respective edge portions associated with the socket means 32 and 40. This enables the weight supported by the various shelf members 12 to be more evenly distributed while the entire system is under load. Similarly, as shown in FIG. 8, it is also recognized, although certainly not required, that the overall height of the respective wall portions 50 could be made so as to correspond substantially to the depth associated with the respective cavities 34 and 42 such that the distal or terminal end portions 54 of the wall portions 50 will abut the respective upper and lower surfaces 38 and 48 associated with intermediate wall member 46 as best shown in FIG. 8. This would also help support the weight/load distribution.

The opposite end portion of the adapter 20 includes socket means 58 as best shown in FIG. 6. The socket means 58 includes an opening or cavity 60 adapted to cooperatively receive and engage either correspondingly shaped end portion associated with the respective upright support members such as the members 14 and 18. The cavity 60 is shown as being substantially square in shape and includes side wall portions 62, 64, 66 and 68 and a bottom floor surface 70, all of which form locating surfaces for positioning and locating the opposed end portions of the respective support members within such cavity. As best shown in FIGS. 7 and 8, the floor surfaces 56 and 70 define a common wall between the enclosure 51 formed by wall portions 50 and the cavity 60 formed by adapter socket means 58.

It is important to note that the peripheral or circumferential wall portion 55 is angularly related to the horizontal as best shown in FIG. 7. The peripheral wall 55 forms an acute angle with the horizontal and, since the locating wall portions 50 are perpendicularly oriented with respect thereto, the wall portions 50 are likewise angularly oriented with respect to the side walls 62–68 defining the adapter socket portion 58. The angle of inclination associated with the peripheral wall 55 therefore corresponds to the angle of inclination imparted to a particular shelf member engaged with the present adapter 20 as best shown in FIG. 8. Also, this angle of inclination is likewise manifested in the angular relationship between the respective longitudinal axes A and B illustrated in FIG. 7, the axis A representing the longitudinal axis taken through the center of the socket means 58 and axis B representing the longitudinal axis taken through the center of the engagement means formed by locating wall portions 50. The angular relationship between the axes A and B (FIG. 7) likewise corresponds to the angle of inclination associated with the wall portion 55, which angle of inclination is preferably in the range of approximately 7° to 9°. Although inclination angles in the range of 7° to 9° are optimal for numerous gravity feed applications, it is recognized that any desired angle of inclination can be designed into the present adapter 20 by merely inclining the peripheral wall 55 accordingly. The wall portion 55 also represents the proximal area or plane of intersection between the opposed end portions of the adapter 20 as well as the respective engagement means associated therewith.

In addition to the angular relationship between the respective opposite end portions of the adapter 20 as just explained, it is also important to note that the engagement means defined by the locating wall portions 50 is not centrally located between the respective edge portions 72 and 74 associated with the inclined peripheral wall portion 55, but instead, as best seen in FIG. 7, such engagement means are offset or shifted towards one side thereof such that the locating wall portions 50 are positioned closer to one edge of the adapter as compared to the other. This means that the shoulder edge portion 72 is substantially smaller dimensionally as compared to the opposed shoulder edge portion 74 as seen in FIG. 7. This offset or shifting of the locating walls 50 as described above in turn shifts the point of intersection C of the respective axes A and B toward one end of the adapter 20 as shown in FIG. 7, the direction and amount of offset being determined by the desired angle of inclination and the geometry associated with the particular application, the direction of such shift in the embodiment shown in FIGS. 5–7 being towards the distal end portions 54 of the wall portions 50. Without this offset or shifting of the cooperatively engageable means formed by locating wall portions 50 toward one edge portion of the inclined peripheral wall 55 as shown in FIG. 7, engagement of the adapter 20 with both the upper and lower socket means 32 and 40 would not produce vertically aligned upright support members 14 and 18 as shown in FIG. 8.

This offsetting or shifting of the intersection point C of the respective axes A and B is important because this permits the same configuration of adapter 20 to be used for engagement both below a particular shelf member 12 for support thereof at a particular angle of inclination and above the same shelf member 12 for vertically aligning the support members positioned thereabove for engagement with still additional shelf members 12 as illustrated in FIG. 8. This interchangeable use of the present adapter 20, both above and below a particular shelf member 12, is possible only because of the offset relationship just described and this is important to the present invention because the same adapter 20 may be used to maintain coaxial alignment of all upright support members utilized in a particular modular display regardless of the angular orientation of individual shelf members associated therewith. This enables a user to produce a display arrangement similar to that shown in FIG. 1 wherein some of the shelf members are angularly oriented relative to the horizontal while others remain in their original horizontal orientation. In this regard, in viewing the display arrangement illustrated in FIG. 1, it should be noted that slightly longer support members such as the support members 18 will be required adjacent the rear portion of the lowermost converted shelf member in order to compensate for the increase in elevation of the rear portion of such lowermost angularly oriented shelf member due to angular orientation relative to the horizontal shelf member or other horizontal surface located therebelow. Similarly, where horizontally oriented shelf members are to be located above the angularly oriented shelf members, support members 18 would be necessary adjacent the front portion of the uppermost angled shelf member so as to compensate for the difference in elevations between the front and rear end portions of the uppermost converted shelf member. The support members 18 are substantially identical in construction to the support members 14 and differ therefrom in length only, the increase in length being dependent upon the particular angle of inclination imparted to such shelf members by the adapter 20. The appropriately dimensioned support members 18 can be provided in a conversion kit along with the present adapters 20. It is also recognized that instead of increasing the overall length of rear support members 18, the front support members could alternatively be decreased in length to compensate for the difference in elevation between the front and rear portions of an angularly oriented shelf member, although this . would result in a corresponding decrease in the vertical space between adjacent shelf members which may affect the height of the particular products merchandised from such display.

The offset arrangement associated with the present adapter 20 as illustrated in FIG. 7 is importantly distinguishable over conventional pipe elbows and the like in that the respective longitudinal axes associated with the opposed end portions of a conventional elbow construction, although angularly related, will always intersect each other along the plane of intersection between the two angularly oriented portions or in the proximal area therebetween. In comparison to the construction of the present adapter 20 illustrated in FIG. 7, this means that the longitudinal axis of a conventional elbow construction would intersect at a point comparable with reference point D illustrated in FIG. 7. Since, in a conventional elbow arrangement, there is no shifting of one opposed end portion relative to the other along the plane of or in the proximal area of intersection therebetween as is true of the present adapter 20, a conventional elbow arrangement will not provide vertical alignment of support members as previously explained.

FIG. 8 illustrates how the present adapter means 20 can be utilized in conjunction with a typical shelf member 12 to achieve angular orientation thereof. More particularly, FIG. 8 shows in detail how the adapters 20 engage the respective upper and lower socket means 32 and 40 associated with a particular shelf member 12. For example, as can be seen from FIG. 8, the present adapter 20 is engaged with the lower shelf socket means 40 such that the inclined peripheral wall portion 55 with associated shoulder edge portions 72 and 74 abut the lower edge portion of the shelf member 12. When so engaged, the lower adapter 20 imparts a specific angle of inclination to the shelf member 12 when the adapter socket means 58 are correspondingly engaged with upright support members 14. When the shelf member 12 is angularly oriented as illustrated in FIG. 8, the upper shelf socket means 32 will likewise be angularly oriented and out of alignment with the support members 14 located therebelow. In order to correct this situation, additional adapter means will be necessary if one is to continue the stacking process and vertically align additional support members thereabove. This realignment of the now angularly oriented shelf socket means 32 is accomplished by using the same adapter 20 and merely inverting and rotating the same 180° so as to engage the locating wall portions 50 with the upper shelf socket 32 as illustrated in FIG. 8. When the upper adapter 20 is so engaged, the inclined peripheral wall portion 55 and its shoulder edge portions 72 and 74 abut the upper edge portion of the shelf member 12 as illustrated in FIG. 8. This inversion and rotation of the adapter means 20 positions the upper adapter socket means 58 in alignment with the lower adapter socket means 58 so that engagement of additional support members 14 will result in vertically aligned upper and lower support members 14 as illustrated in FIG. 8. When assembled and engaged as described, the terminal end portion of each of the respective support members 14 lies in contact with the bearing surface 70 associated with the adapter socket means 58 as illustrated. Use of the present adapters 20 at each respective corner of the various shelf members 12 will reorient such shelf members from a horizontal arrangement to an angularly related orientation as illustrated in FIGS. 1 and 8. This process can be further continued to achieve any desired number of vertically disposed, angularly oriented shelf members.

Although the various components of the known modular display units could be constructed and fabricated from various acceptable materials of construction, such components are, in many cases, constructed from a relatively rigid plastic material able to withstand moderate impact and mishandling without breakage. Plastic materials are also somewhat resilient and elastic and are ideally suited for fabricating the present adapter means since the resulting spring tension of plastics achieves the necessary structural rigidity of the connection between the adapter and both the upright support members and shelf sockets. It is also recognized that certain metal, metal alloys, fiberglass, or even wood or other materials could likewise be utilized in the practice of this invention but plastics have found to be preferred. In any event, the material utilized should be compatible and comformable with the materials comprising the various components of the particular system to be converted.

It is also important to note that the overall dimensions of the display unit 10 illustrated in FIG. 1 as well as the particular configuration of the shelf members 12, the support members 14, 16 and 18, and the present adapters 20 are subject to wide variations and each of the members associated with the unit 10 as well as the present adapter 20 may be sized and shaped into a variety of different sizes and configurations to accommodate different display applications, different product sizes and shapes, and to conform with any space limitations without impairing the teachings and practice of the present adapter construction. Although the present adapter has particular utility in a merchandising environment, its simplicity, durability, flexibility and versatility greatly increases its usefulness and effectiveness in a wide variety of other applications.

Thus, there has been shown and described improved adapter means for converting one or more of the horizontal shelf members associated with existing modular display units to angularly oriented display areas, which adapter means fulfills all of the objects and advantages sought therefor. Many changes, modifications, variations, and other uses and applications of the present adapter construction will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. Adapter means for angularly orienting at least one horizontally disposed shelf member in a modular display unit having one or more similar shelf members vertically arranged in spaced apart relationship one above the other and having a plurality of support members disposed therebetween connecting vertically spaced pairs of said shelf members, each shelf member having engagement means associated with the upper and lower portions thereof for cooperatively engaging the opposed end portions of said support members, said adapter means comprising a member having first and second opposed end portions, means associated with said first adapter end portion for cooperatively engaging the engagement means associated with the upper and lower portions of said shelf members, means associated with said second adapter end portion for cooperatively engaging the opposed end portions of said support members, said first adapter end portion being angularly oriented relative to said second adapter end portion so as to impart an angle of inclination to said shelf members when said adapter means are operatively positioned between and engaged with respective ones of said shelf members and said support members, and means associated with said adapter member for maintaining the support members engaged therewith in corresponding vertical alignment with other support members in said modular display unit.

2. The adapter means defined in claim 1 wherein said means associated with said adapter member for maintaining the support members engaged therewith in corresponding vertical alignment with other support members includes transversely offsetting the cooperatively engageable means associated with the first and second opposed end portions of said adapter member.

3. The adapter means defined in claim 1 wherein the adapter members engaged with said upper shelf engagement means are positioned and engaged therewith in a different orientation as compared to the adapter members positioned and engaged with said lower shelf engagement means.

4. The adapter means defined in claim 3 wherein the orientation of each of the adapter members engaged with said upper shelf engagement means is inverted and rotated approximately 180° as compared to the orientation of each of the adapter members positioned and engaged with said lower shelf engagement means.

5. In a modular display unit having a plurality of horizontally arranged shelf members vertically assembled in spaced apart relationship one above the other, a plurality of elongated support members connecting vertically spaced pairs of said shelf members, each shelf member having engagement means associated with the upper and lower portions thereof for cooperatively engaging the opposed end portions of said support members, the improvement comprising adapter means for converting said shelf members from a horizontal orientation to an angularly related orientation, said adapter means including a member having first and second opposed end portions, first cooperatively engageable means associated with said first adapter end portion for engaging the engagement means associated with the upper and lower portions of said shelf members, second cooperatively engageable means associated with said second adapter end portion for engaging the opposed end portions of said support members, said first and second cooperatively engageable adapter means being angularly related and laterally offset relative to each other such that when a plurality of said adapter means are operatively positioned between and engaged with the respective shelf members and support members forming said modular display unit the shelf members engaged with said adapter means will be angularly oriented relative to the horizontal and said support members will be in corresponding vertical alignment throughout said modular display unit.

6. In a modular display unit having a plurality of horizontally arranged shelf members vertically assembled in spaced apart relationship one above the other, a plurality of elongated support members connecting vertically spaced pairs of said shelf members, each shelf member having upper and lower engagement means associated therewith for cooperatively engaging the opposed end portions of said support members, the improvement comprising an adapter member for converting said shelf members from a horizontal orientation to an angularly related orientation, said adapter member having opposed end portions, first means associated with one end portion of said adapter member for cooperatively engaging the upper and lower engagement means associated with each of said shelf members, second means associated with the opposite end portion of said adapter member for cooperatively engaging the opposed end portions of said support members, said first cooperatively engageable adapter means being angularly related and laterally offset relative to said second cooperatively engageable adapter means such that when a plurality of said adapter members are operatively positioned and engaged with the respective upper and lower engagement means associated with at least one horizontally disposed shelf member and a plurality of support members are engaged with said operatively connected adapter members said at least one shelf member will be repositioned to an angular orientation relative to the horizontal and the respective support members located above and below said at least one shelf member will be maintained in corresponding vertical alignment with each other, the adapter members engaged with said upper shelf engagement means being positioned and engaged therewith in a different orientation as compared to the adapter members positioned and engaged with said lower shelf engagement means.

7. Adapter means for angularly orienting at least one shelf member which is horizontally arranged in a modular display unit having one or more similar shelf members and a plurality of elongated support members, said shelf members having a plurality of upper and lower engagement means positioned at spaced locations on the respective upper and lower portions thereof for cooperatively engaging the opposed end portions of said support members, said adapter means comprising a member having opposed end portions, first means associated with one end portion of said adapter member for cooperatively engaging the engagement means associated with the upper and lower portions of said shelf members, second means associated with the opposite end portion of said adapter member for cooperatively engaging the opposed end portions of said support members, said first and second cooperatively engageable adapter means being angularly related relative to each other, and said first cooperatively engageable adapter means being offset relative to said second cooperatively engageable adapter means such that the longitudinal axis taken through the center of said first cooperatively engageable adapter means will intersect the longitudinal axis taken through the center of said second cooperatively engageable adapter means at a point spaced from the proximal area of intersection between said first and second adapter means.

* * * * *

UNITED STATES PATENT AND TRADEMARK OFFICE

CERTIFICATE OF CORRECTION

PATENT NO. : 4,982,849

DATED : January 8, 1991

INVENTOR(S) : Paul L. Flum & Dewalt W. Fowler

It is certified that error appears in the above-identified patent and that said Letters Patent is hereby corrected as shown below:

Column 5, line 8, after "known" insert --modular--.

Column 5, line 59, "differences" should be --different-- and after "different" insert --sizes.

Signed and Sealed this

Twenty-first Day of April, 1992

*Attest:*

HARRY F. MANBECK, JR.

*Attesting Officer*

*Commissioner of Patents and Trademarks*